US008188395B2

(12) United States Patent
Steidle et al.

(10) Patent No.: US 8,188,395 B2
(45) Date of Patent: May 29, 2012

(54) ELECTRIC SWITCH

(75) Inventors: Alfons Steidle, Spaichingen (DE); Klaus Fiederer, Dürbheim (DE)

(73) Assignee: Marquardt GmbH, Rietheim-Weilheim (DE)

( * ) Notice: Subject to any disclaimer, the term of this patent is extended or adjusted under 35 U.S.C. 154(b) by 22 days.

(21) Appl. No.: 12/188,372

(22) Filed: Aug. 8, 2008

(65) Prior Publication Data

US 2009/0026052 A1 Jan. 29, 2009

Related U.S. Application Data

(63) Continuation of application No. PCT/DE2007/000233, filed on Feb. 6, 2007.

(30) Foreign Application Priority Data

Feb. 10, 2006 (DE) ..... 10 2006 006 119
Feb. 10, 2006 (DE) ..... 10 2006 006 120

(51) Int. Cl.
*H01H 19/06* (2006.01)

(52) U.S. Cl. ..... 200/302.1; 200/302.3

(58) Field of Classification Search ..... 200/61.62–61.7, 200/302.1, 284
See application file for complete search history.

(56) References Cited

U.S. PATENT DOCUMENTS

| | | | | |
|---|---|---|---|---|
| 3,890,477 | A | 6/1975 | Saunders | |
| 4,314,124 | A | 2/1982 | Sauer et al. | |
| 4,591,683 | A * | 5/1986 | Eke | 219/681 |
| 4,701,581 | A | 10/1987 | Wodnicki et al. | |
| 4,839,483 | A * | 6/1989 | Doyle | 200/302.1 |
| 4,918,270 | A * | 4/1990 | Orrico | 200/302.2 |
| 5,164,561 | A | 11/1992 | Schaeffeler et al. | |
| 5,217,387 | A * | 6/1993 | Hull et al. | 439/367 |
| 5,260,531 | A | 11/1993 | Yarbrough et al. | |
| 5,349,147 | A * | 9/1994 | Gallone | 200/552 |
| 5,488,209 | A * | 1/1996 | Orrico et al. | 200/61.7 |
| 5,864,455 | A | 1/1999 | Gernhardt et al. | |
| 5,975,940 | A | 11/1999 | Hartmann et al. | |
| 6,359,243 | B1 * | 3/2002 | Nakade et al. | 200/6 A |
| 7,273,389 | B2 * | 9/2007 | Hoppach et al. | 439/425 |

FOREIGN PATENT DOCUMENTS

| | | | |
|---|---|---|---|
| CN | 2034737 | U | 3/1989 |
| DE | 391 155 | C1 | 3/1924 |
| DE | 728 735 | C1 | 12/1942 |
| DE | 10 75 189 | B | 2/1960 |
| DE | 28 53 880 | A1 | 6/1980 |
| DE | 31 50 210 | A1 | 7/1983 |
| DE | 83 35 104 | U1 | 7/1984 |
| DE | 88 06 920 | U1 | 7/1988 |
| DE | 40 11 875 | A1 | 10/1991 |
| DE | 40 16 023 | A1 | 11/1991 |
| DE | 298 00 360 | U1 | 4/1998 |

(Continued)

*Primary Examiner* — Lincoln Donovan
*Assistant Examiner* — Lisa Klaus
(74) *Attorney, Agent, or Firm* — Burr & Brown

(57) ABSTRACT

The invention relates to an electrical switch for an electrical appliance, in particular for an electrical tool, such as a drill, a grinder, a saw, a plane, an angle grinder or the like, and having a housing. The switch has a contact system which is located in the housing, and electrical connections, which lead into the housing and/or are located in the housing, for electrical supply lines to the contact system. Furthermore, the switch may have an operating member for switching action on the contact system, with the contact system being operatively connected to the operating member by means of an elastic element. The electrical connections have seals.

17 Claims, 7 Drawing Sheets

FOREIGN PATENT DOCUMENTS

| | | | |
|---|---|---|---|
| DE | 197 01 584 | C2 | 7/1998 |
| DE | 199 61 764 | A1 | 6/2001 |
| DE | 102 17 406 | A1 | 10/2002 |
| DE | 196 54 611 | B4 | 9/2004 |
| DE | 20 2004 005 878 | U1 | 10/2005 |
| DE | 20 2005 014 686 | U1 | 12/2005 |
| DE | 10 2004 027 868 | B3 | 2/2006 |
| FR | 2 397 710 | A1 | 2/1979 |
| FR | 2 698 757 | A1 | 6/1994 |
| GB | 2 112 210 | A1 | 7/1983 |
| GB | 2 196 792 | A1 | 5/1998 |

* cited by examiner

ELECTRIC SWITCH

CROSS REFERENCE TO RELATED APPLICATION

This application is a continuation of International Application No. PCT/DE2007/000233 having an international filing date of Feb. 6, 2007, which designated the United States, and claims the benefit under 35 USC §119(a)-(d) of German Application No. 10 2006 006 119.5 filed Feb. 10, 2006 and German Application No. 10 2006 006 120.9 filed Feb. 10, 2006, the entireties of which are incorporated herein by reference.

FIELD OF THE INVENTION

The invention relates to an electrical switch.

BACKGROUND OF THE INVENTION

Switches such as these are primarily used as mains switches for electrical appliances, in particular for electrical hand held tools. An electrical tool such as this may be a drill, a grinder, a saw, a plane, an angle grinder or the like.

DE 40 11 875 A1 discloses an electrical switch having a housing in which a contact system is located which has fixed contact and a switching contact. The switch also has an operating member for switching action on the contact system, with the switching contact being at a distance from the fixed contact in a first position, and with the switching contact resting on the fixed contact in a second position. The contact system in the known switch has a complex design.

Furthermore, the switch has electrical connections which are electrically connected to the contact system. The electrical supply lines for supplying the electrical voltage to the contact system can be fitted to the electrical connections.

In the known switch, the electrical connections are arranged in a largely freely accessible form on the housing. The connections are therefore subject to dirt, with water, dust or other hazardous substances being able to penetrate via the connections into the interior of the housing, which in turn can lead to premature failure of the contact system. Finally, in the case of angle grinders, for example single-handed angle grinders, which are used for machining metals, voltage flashovers can occur from one pole to another as a result of metallic grinding dust accumulating on the external live parts of the connections. This frequently results in premature failure of the machine. In addition, there is a risk of voltage flashovers on the switch occurring to areas of the angle grinder which can be touched from the outside, which in the worst case can lead to a state representing a lethal danger to the user.

SUMMARY OF THE INVENTION

The invention is based on the object of further developing the electrical switch such that it is largely protected against the influence of hazardous substances. In particular, no live parts of the switch should be accessible for metal dust to accumulate on in the state in which the electrical supply lines are connected to the switch. If appropriate, the electrical switch should be further developed such that the contact system is of simple design. In particular, the contact system should be equally suitable for direct current and/or alternating current, and it should be possible to use the switch in single-handed angle grinders.

In accordance with the configuration of the switch according to the invention, the electrical connection has a seal and/or a seal is associated to the electrical connection. The seal expediently surrounds the supply line in the form of encapsulation. This results in a protective embodiment of a switch, therefore largely avoiding premature failure of the switch. The life of the switch is therefore advantageously increased. Further embodiments of the invention are disclosed in subsequent paragraphs of this specification.

The electrical connection can be arranged on the switch such that it leads into the housing and/or is located in the housing. Expediently, the seal has an essentially round cross section, in particular in the form of a sleeve, with the seal being designed such that it essentially corresponds to the electrical supply line. The seal can be produced from a flexible elastic material, such as a thermoplastic elastomer, a foam in the form of a foam seal, or the like. In consequence, the seal rests on the respective supply line for the connection with a certain contact pressure, which in turn further improves the sealing effect. This advantageously also allows different conductor cross sections for the electrical supply line, for example for an electrical tool operated at 120 V or at 230 V, to be held by the same seal, thus reducing the cost of the switch.

The electrical connection can be associated with an aperture into the interior of the housing and/or can be arranged on the aperture, with the seal cladding the aperture, forming a seal. The seal can be inserted in the aperture, can be placed on a corresponding attachment on the surface of the housing in the area of the aperture, can be injection molded in the aperture, or the like, in a simple manner, which is convenient for assembly.

The electrical connections may be arranged in the housing in a separate connecting area which, for example, is in the form of a chamber. The connecting area is provided with a first cover, which is located on the lower face of the housing, so that the connecting area is protected against the influence of hazardous substances. The first cover can be designed such that it can be folded up, therefore making it easier to fit the supply lines to the connections, and/or to remove them. A cover such as this which can be folded also, of course, offers other access to the interior of the switch when necessary. For the sake of simple fitting, the first cover can be fitted to the housing by means of a film hinge, or the like. Furthermore, a pivoting hinge may be provided in order to lock the cover to the housing, therefore effectively counteracting the housing which has been closed by the first cover from gaping open. Closing the cover is made easier by the capability to attach the first cover to the housing by means of latching and/or snap-hooks, locking hooks and latching studs or the like, which, for example, are located on the side of the housing. A good seal is achieved on the first cover by the first cover closing the housing, forming a seal, by means of a tongue and groove geometry, by means of an elastomer insert, or the like.

The switch may contain an electronic/electrical circuit arrangement which, for example, is used for open-loop and/or closed loop control of an electric motor in the electrical appliance or the electrical tool, and is normally arranged on a printed circuit board. This allows these electronics to be accommodated in a space-saving, manner, in the separate connecting area. The electronics are preferably inserted into the first cover, and, to be precise, the printed circuit board can easily be mounted in the first cover, by being latched in.

The housing of the switch may have an approximately cuboid shape. In order to allow the contact system as well as other parts of the switch to be fitted easily, the housing is designed to be open on the side facing the operating member. In order to close the open side of the housing, an integral, second cover which is composed at least partially of elastic material is arranged there. The second cover is, in the area of the operating member, in the form of a thin-walled, elastic and approximately bell-shaped bellows, with the bellows surrounding the operating member, on a groove which is located in the operating member, in an interlocking and/or force-fitting manner by means of an opening. This allows the user to move the operating member while nevertheless also ensuring secure sealing into the interior of the housing in this area. That edge of the housing which is associated with the open side has a circumferential groove, in which a circumferential web on the second cover engages in an interlocking and/or force-fitting manner, in order to provide a good seal.

Furthermore, a capacitor can also be arranged in the housing, and is used for example to provide suppression for the electric motor in the electric tool. All the electrical connection elements and the suppression capacitor are therefore accommodated in the switch housing, such that they are protected against dust or the like. Furthermore, there are no live parts on the outside of the switch, therefore effectively preventing corresponding hazards. For the sake of simple assembly, the capacitor may be located in a holding compartment in the housing, with the holding compartment being closed by means of the second cover.

In order to make it easier to fit the electrical supply lines to the switch, the electrical connection can be in the form of a push-in connection for simple insertion of the electrical supply line. In one preferred refinement, the electrical push-in connection has a stationary contact spring and/or a stationary contact web, as well as an elastically moving contact spring, such that the electrical supply line is plugged in and held by means of contact pressure between the two contact springs and, respectively, between the contact web and the contact spring.

In order to allow the switch to be replaced easily when necessary, the electrical supply lines can be detached again from the push-in connections. For this purpose, the electrical supply line can be detached in the electrical connection by means of a control cam which acts on the moving contact spring for the electrical connection. In one preferred refinement, the control cam comprises a wheel which can rotate and has an eccentric, with the eccentric moving the moving contact spring against its spring force during rotation of the wheel. The wheel can be mounted in the first cover such that it can rotate and/or can be injection molded in the first cover during its production, such that it can move, such that the wheel is accessible in order to detach the electrical supply line when the housing has been closed by means of the first cover.

Furthermore, in the switch according to the invention, the switching contact can be mounted such that it can move with respect to the operating member, with the switching contact being operatively connected to the operating member by means of an elastic element. The switching contact can therefore be switched between the two positions during movement of the operating member, in particular in the form of a snap-action movement. The contact system therefore has an acceleration area for the switching contact, such that the mode and direction of operation for the switch comply in particular with requirements for single-handed angle grinders.

Normally, the contact system is located in a housing of the switch. For particular suitability for single-handed angle grinders, the switching contact may be in the form of a contact link in order to bridge two fixed contacts.

A contact lug expediently leads from the fixed contact to an electrical connection, which is located in and/or on the housing, for an electrical supply line, which is used in particular to supply the electrical voltage to the contact system. In order to ensure that the supply line can be fitted to the switch easily, the electrical connection may be in the form of a push-in connection.

The operating member has a pusher which projects out of the housing for manual movement by the user. In one particular refinement of the acceleration area for the switching contact, the operating member has a carriage in the form of a frame, with the pusher being fitted to the carriage. The frame for the carriage is expediently approximately U-shaped with a base and two side limbs. A slide is mounted on the carriage such that it can move, and the slide can be guided on the base of the U of the carriage. For its part, the switching contact is arranged on the slide, to be precise in particular by means of a system spring which is used to make elastic contact with the fixed contact in the second position.

In one cost-effective embodiment, the elastic element is in the form of a leaf spring, for example, a plastic leaf spring. One end of the elastic element is attached to the carriage. Both ends of the elastic element are each expediently injection molded on one side limb. At the same time, this saves a conventional mechanical component, by using an injection molded plastic spring instead of an additional mechanical acceleration spring. The elastic element can be held in a simple form on the slide in an eye-like holder, for example. In one embodiment of the present invention, the plastic leaf spring is held in the holder approximately centrally between the two injection molded ends.

In a further embodiment, the slide is coupled to the carriage. For this purpose, an elongated hole is located on each side limb of the U-shaped carriage, with a pin on the slide engaging in the elongated hole for coupling purposes. Two opposite pins expediently engage on both sides on the slide, in a respective elongated hole on the two mutually opposite side limbs of the U-shaped carriage, in order to ensure interference-free movement of the slide. In order to assist in production of the snap-action effect, the end of the pin can be provided with a spherical catch which interacts with the housing during movement of the carriage.

Finally, a spark shield can also be fitted to the slide, and can be moved between the two fixed contacts during switching between the two positions. This interrupts any arc which may occur during switching, thus protecting the contact system against premature failure.

The advantages achieved by the invention are, in particular, that this switch effectively avoids dangerous voltage flashovers, and ensures safe operation of the electrical tool. The switch can be electrically connected in the electrical tool particularly easily from one side and quickly, because of the push-in connections. An electronics board which, for example, includes restarting protection for the electrical tool, can optionally be integrated in and made contact with in the lower closure cover of the switch, with little effort.

The advantages achieved by the invention are also that this results in a relatively physically small switch which is nevertheless suitable for switching heavy currents in the DC and/or AC voltage range. Furthermore, the number of components for the contact system is less than in previous switches, as a result of which the switch costs less, despite the advantages of the disclosed snap-action electric switch system.

BRIEF DESCRIPTION OF THE DRAWINGS

Exemplary embodiments of the invention together with various embodiments will be described in more detail in the following text and are illustrated in the drawings.

DETAILED DESCRIPTION OF THE INVENTION

Figure 1:
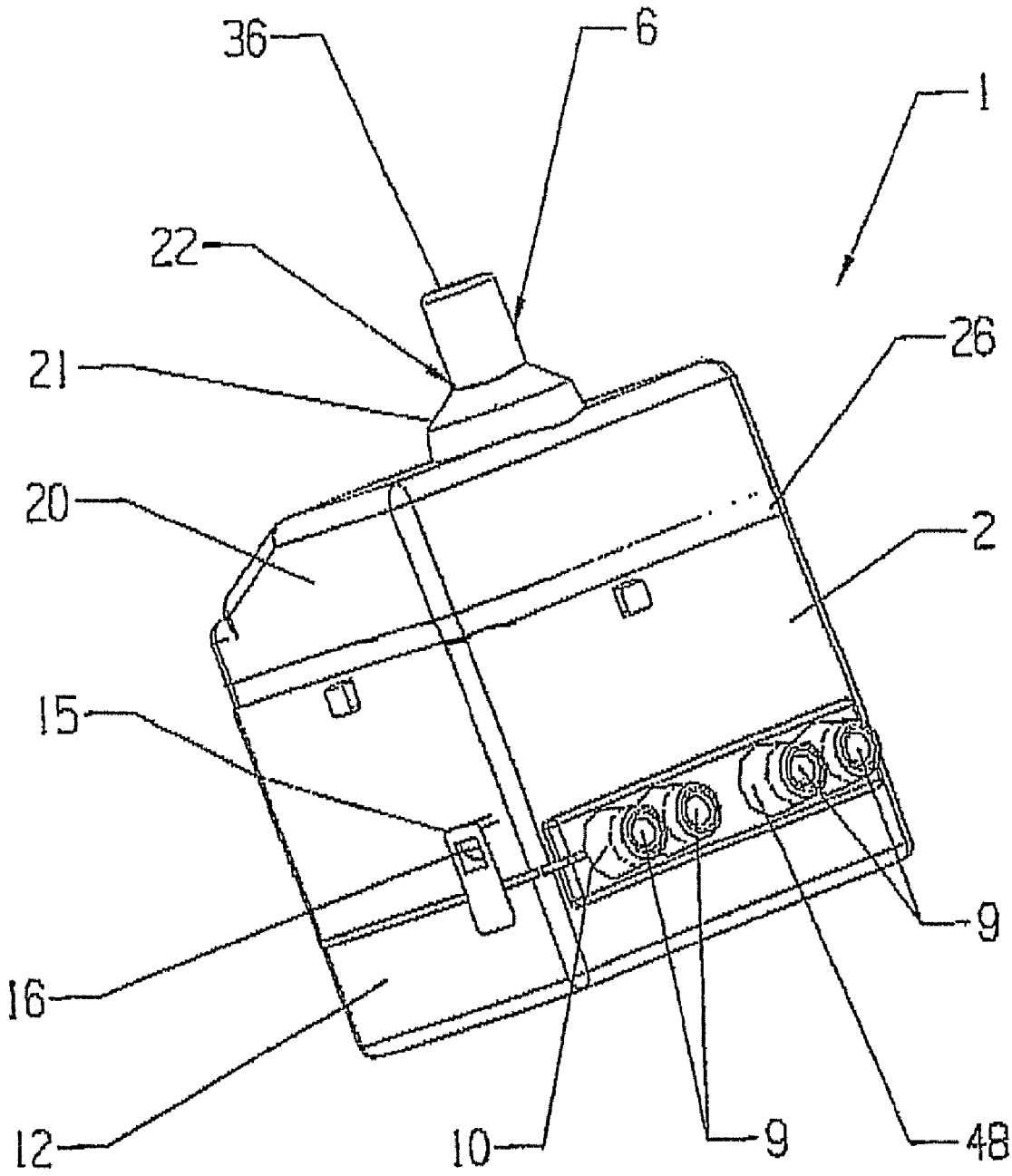
FIG. 1 shows a perspective view of an electrical switch.
Figure 5:
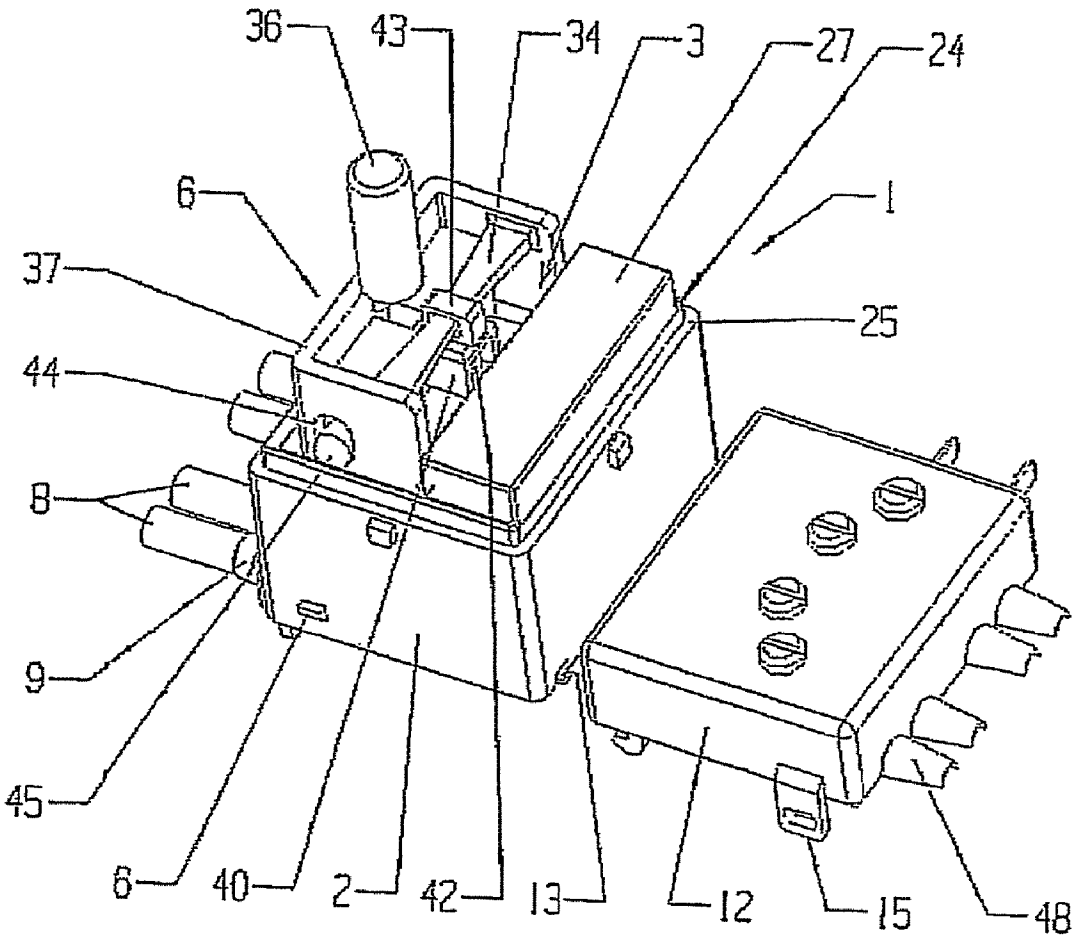
FIG. 5 shows the electrical switch as in FIG. 4, with the cover on the upper face having been removed.

FIG. 1 shows an electrical switch 1 which can be used for an electrical appliance, to be precise for, an electrical tool with an electric motor. The electrical tool may be a drill, a grinder, a saw, a plane, an angle grinder or the like. The switch 1 has a housing 2 which is composed of a thermoplastic and has a first cover 12, which is arranged on the lower face, as well as a second cover 20, which is arranged on the upper face. A contact system 3 is located in the housing 2, as can be seen in FIG. 5. The contact system 3, which is illustrated in more detail in FIG. 7, has a fixed contact 4 as well as a switching contact 5. An operating member 6 with a pusher 36 which projects out of the housing 2 and can be moved by the operator is used for switching action on the contact system 3, so that the switching contact 5 is at a distance from the fixed contact 4 in a first position, and the switching contact 5 rests on the fixed contact 4 in a second position. In the present case, the contact system 3 has two fixed contacts 4, 4', with the switching contact 5 being in the form of a contact link in order to bridge the two fixed contacts, 4, 4' in the second position.

Figure 3:
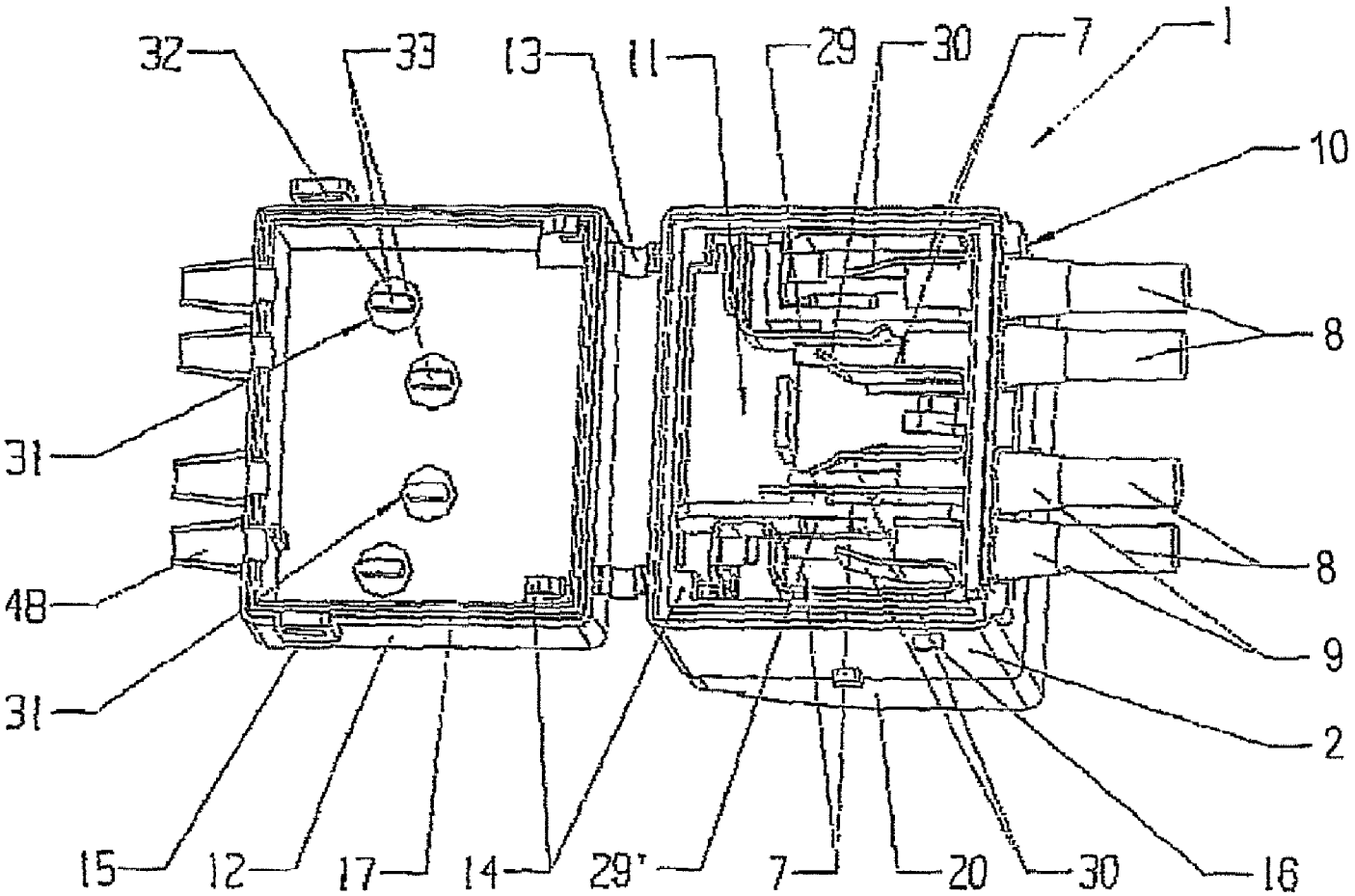
FIG. 3 shows the electrical switch as in FIG. 2, but without any electronics inserted in the cover.

In order to supply the electrical voltage to the contact system 3, the switch 1 has electrical connections 7 which lead into the housing 2 and/or are located in the housing 2, as shown in FIG. 3. The electrical supply lines 8 for the switch 1 can be connected to the connections 7. In order to prevent hazardous substances from entering the housing 2, the electrical connections 7 have seals 9.

Figure 2:
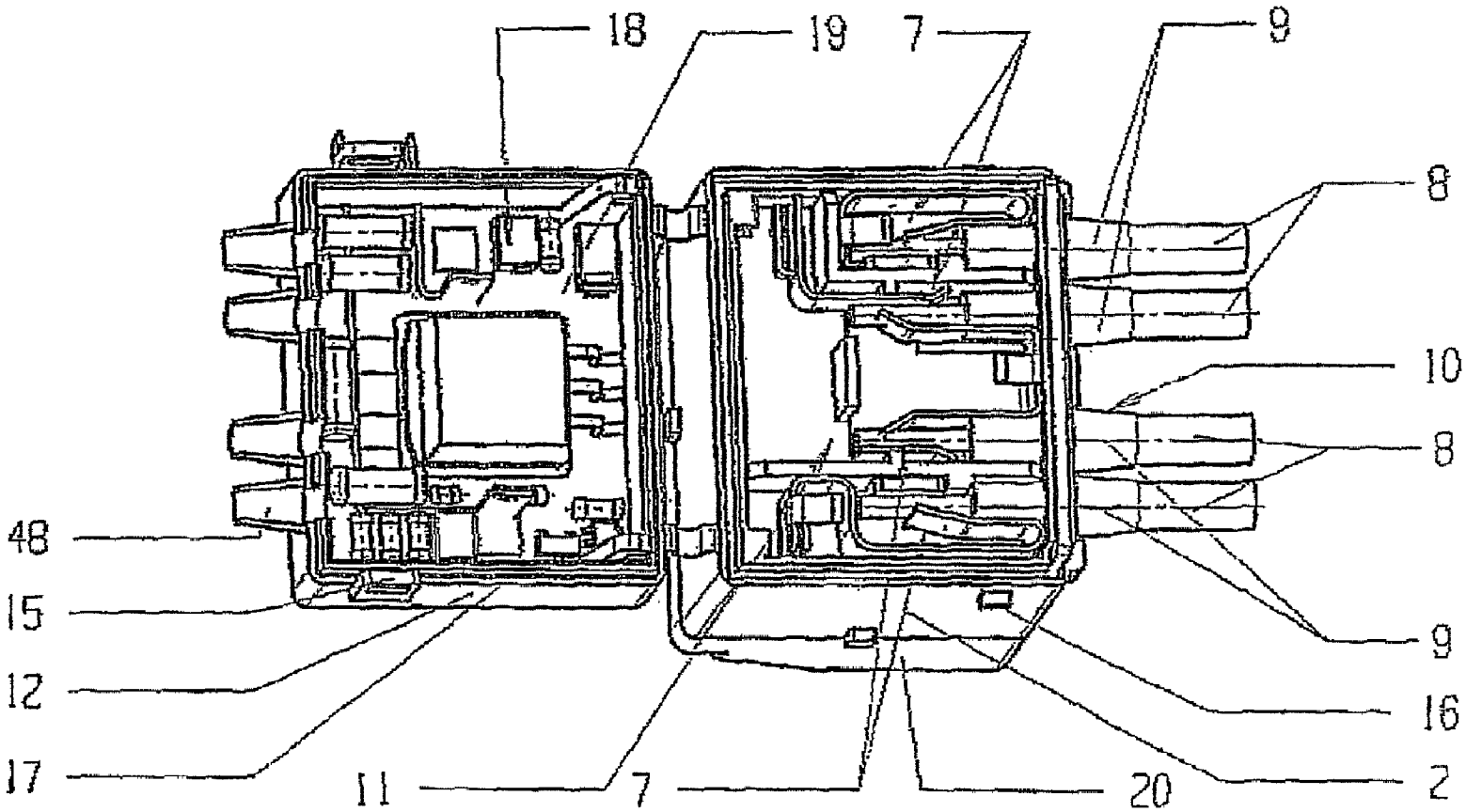
FIG. 2 shows the electrical switch with the cover open on its lower face.

The seal 9 is in the form of a sleeve and has an essentially round cross section. In order to ensure a particularly good seal effect, the seal 9 is composed of a flexible elastic material. This material may be a thermoplastic elastomer, a foam for a type of foam seal, or the like. In consequence, the seal 9 rests on the respective supply line 8 for the connection 7 with a certain contact pressure. An aperture 10 leads into the interior of the housing 2 for the electrical connection 7. The seal 9 clads the aperture 10, forming a seal. The seal 9 is expediently inserted in the aperture 10. The seal 9 can also be fitted on a corresponding attachment, which is not shown in any more detail, on the surface of the housing 2 in the area of the aperture 10, or can be composed of elastic plastic and injection molded or the like in the aperture 10. In particular, all of the seals 9 may be in the form of a common, integral sealing part, as shown in FIG. 2, which is inserted into the aperture 10 on the housing 2 for the connecting area 11, which is described in the following text. The individual seals 9, which are associated with the supply lines 8, are surrounded by half-shells 48 on the first cover 12 and on the housing 2, when the housing 2 is closed.

Figure 4:
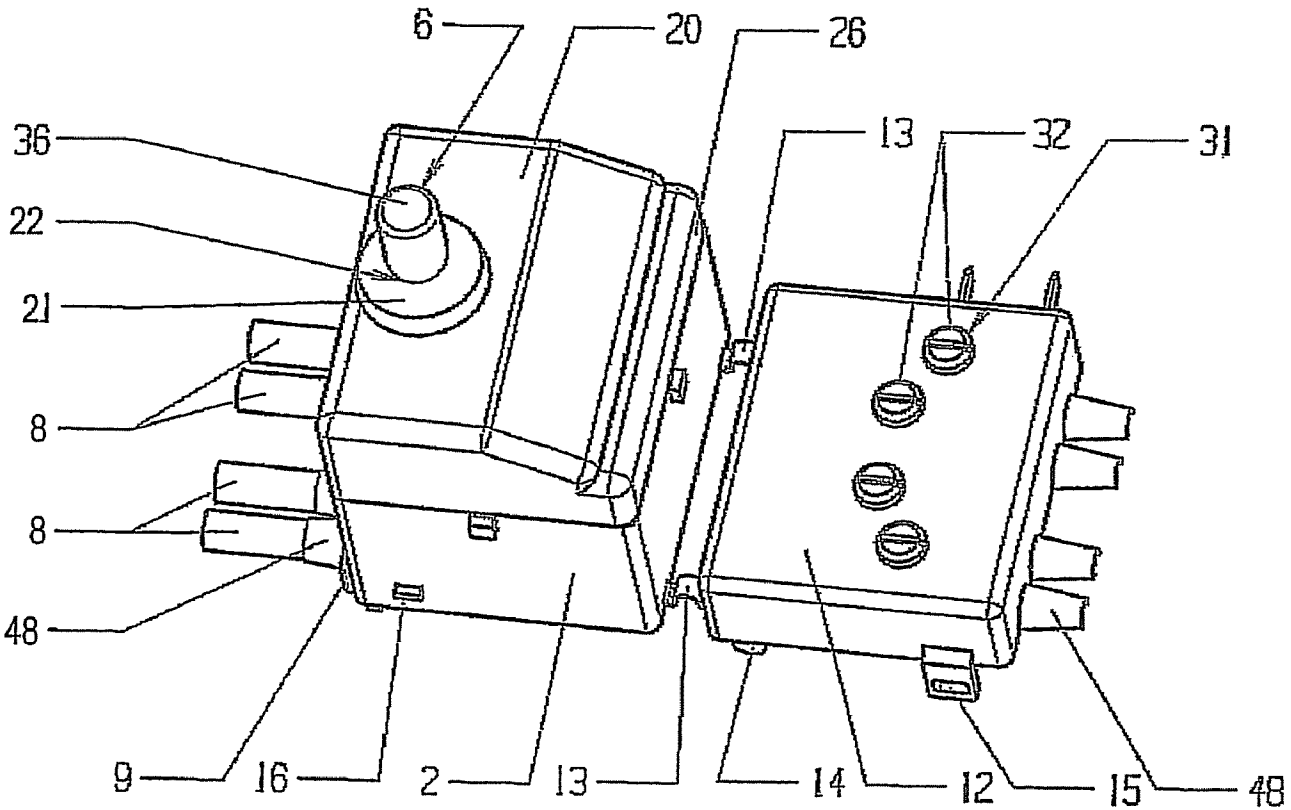
FIG. 4 shows the electrical switch with the cover open on its lower face, but seen from the upper face.

The electrical connections 7 are arranged in a separate connecting area 11 in the housing 2. The connecting area 11 is in the form of a chamber, as can be seen in FIG. 3. In order to allow the supply lines 8 to be fitted to the connections 7 easily, the connecting area 11 is provided with the first cover 12, which is located on the lower face of the switch 1. As shown in FIG. 4, the first cover 12 can be folded up. For this purpose, the first cover 12 is fitted to the housing 2 by means of a film hinge 13. The first cover 12 can also be attached to the housing 2 by means of locking hooks 15 and latching studs 16, which are shown in FIG. 3, as well as latching and/or snap-action hooks or the like, which are located on the side of the housing 2. Furthermore, a pivoting hinge 14 is used to lock the first cover 12 to the housing 2, thus preventing the housing 2 from gaping open at this point. The first cover 12 closes the housing 2 on the lower face, forming a seal, by means of a tongue and groove geometry 17, by means of an elastomer insert, or the like.

As can be seen in FIG. 2, an electronic/electrical circuit arrangement 18 can be located in the connecting area 11 and is used for open-loop and/or closed-loop control of the electric motor in the electrical tool. These electronics 18 are arranged on a printed circuit board 19 and are inserted into the first cover 12. For example, the printed circuit board 19 is mounted in the first cover 12 by being latched in.

Figure 7:
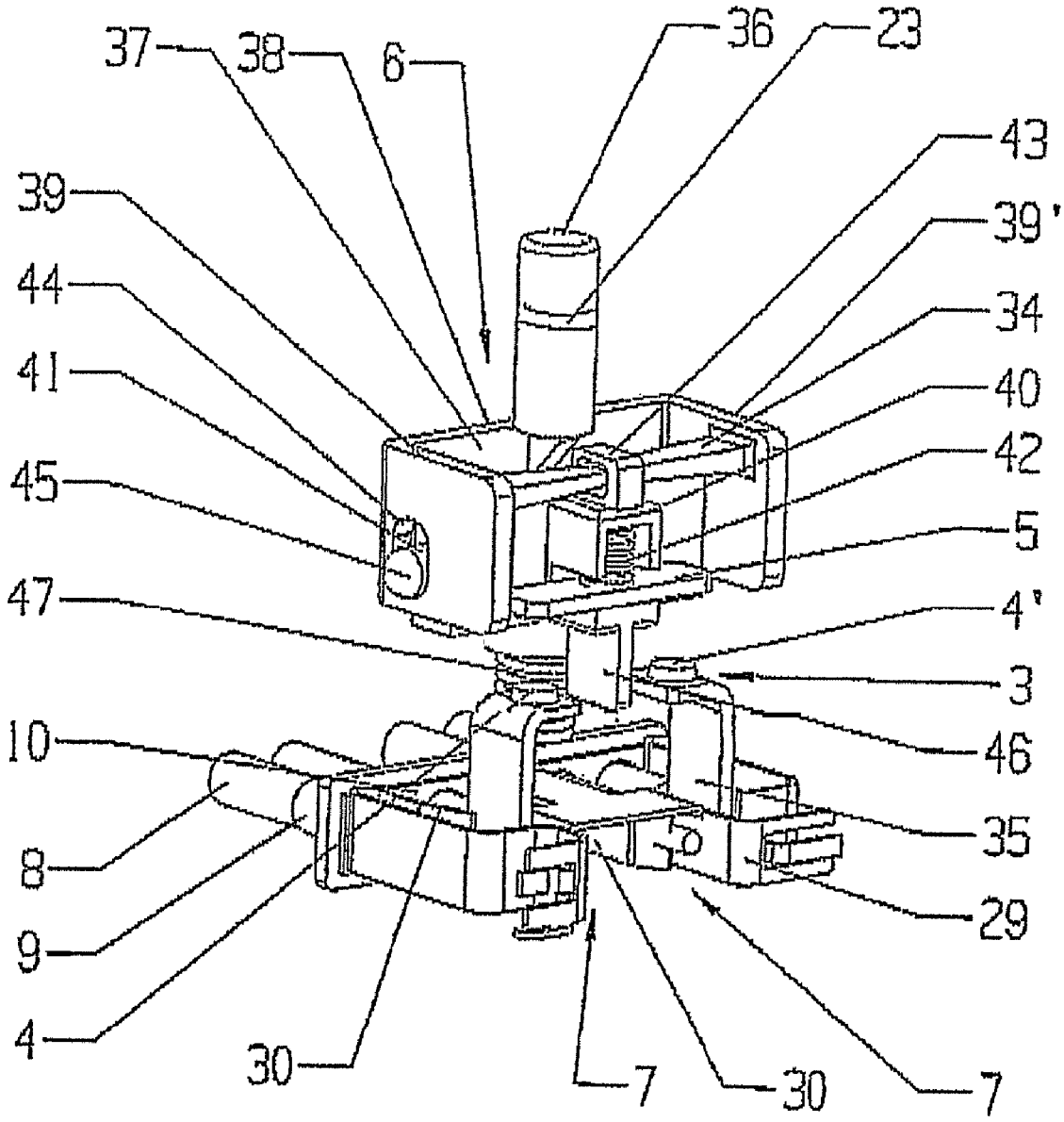
FIG. 7 shows the contact system as a single part.

As can be seen from FIG. 5, the housing 2 has an approximately cuboid shape. The housing 2 is open on the side facing the operating member 6. The integral, second cover 20, which is composed at least partially of elastic material, is arranged on the open side of the housing 2, to be precise on the upper face, as can be seen in FIG. 4. The upper portion of the second cover 20 in the area of the operating member 6 is a thin-walled elastic approximately bell-shaped bellows 21. The bellows 21 surrounds the operating member 6 in an interlocking and/or force-fitting manner by means of an opening 22 on a groove 23, which is shown in FIG. 7, and is located in the operating member 6. The edge 24 on the housing 2, which is associated with the open side, has a circumferential groove 25, which can be seen in FIG. 5, and in which a circumferential web 26 on the second cover 20 engages in an interlocking and/or force-fitting manner, as shown in FIG. 1.

Figure 6:
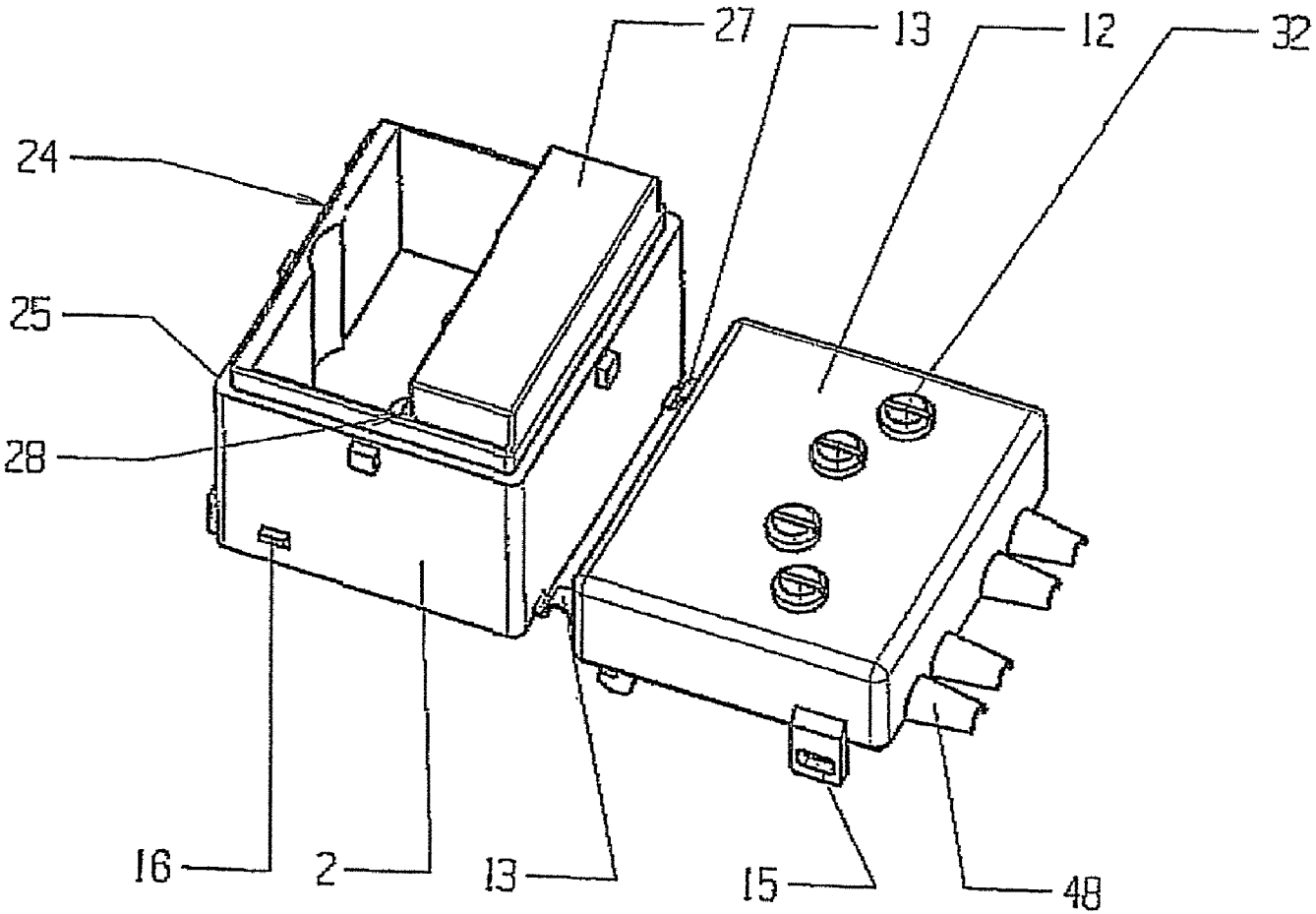
FIG. 6 shows the electrical switch as in FIG. 5, but with the contact system having been removed.

A capacitor 27, which is shown in FIG. 5 and is used to provide suppression for the electric motor in the electrical tool, is arranged in the housing 2, and is protected against dust. For this purpose, the housing 2 has a holding compartment 28 in which the capacitor 27 is located, as can be seen in more detail in FIG. 6. The holding compartment 28 is closed by means of the second cover 20.

As can be seen from FIG. 3, the electrical connection 7 is in the form of a push-in connection for simple insertion of the electrical supply line 8. The electrical connection 7 has a stationary contact spring 29 and/or a stationary contact web 29', as well as an elastic moving contact spring 30, such that the electrical supply line 8 is plugged in and held by means of a contact pressure between the two contact springs 29, or, respectively, between the contact web 29' and the contact spring 30. A contact lug 35, which can be seen in FIG. 7, leads from the fixed contact 4, 4' to the electrical connection 7 which is located in and/or on the housing 2.

The electrical supply line 8 in the electrical connection 7 can be detached by means of a control cam 31, since the control cam 31 can act on the moving contact spring 30 of the electrical connection 7. As can be seen from FIG. 3 and FIG. 4, the control cam 31 is for example in the form of a wheel 32, which can rotate, with an eccentric 33, with the eccentric 33 moving the moving contact spring 30 against its spring force during rotation of the wheel 32. The wheel 32 is expediently mounted on the first cover 12 such that it can rotate, and is accessible to detach the electrical supply line 8, when the housing 2 is closed by means of the first cover 12. If desired, the wheel 32 can also be injection molded in the first cover 12, during its production, such that it can move, by choosing a plastic which is not linked to the plastic for the cover 12 for the wheel 32. If, as shown in FIG. 2, a printed circuit board 19 with electronics 18 is located in the first cover 12, an opening which corresponds to the wheel 32 may be located in the printed circuit board 19, in order to allow the eccentric 33 to act on the connection 7. However, an alternative arrangement of the control cam 31 is to open the lower first cover 12 in order to detach the push-in connections 7, so that the user can then act directly on the push-in connection 7.

FIG. 7 shows the configuration of the contact system 3 in more detail. The switching contact 5 is mounted such that it can move with respect to the operating member 6, and is operatively connected to the operating member 6 by means of an elastic element 34. The switching contact 5 can therefore be switched between the two positions with a type of snap-action movement, against the force of a compression spring 47 which is located in the housing 2, during movement of the operating member 6.

In order to mount the switching contact 5 such that it can move, the operating member 6 has a carriage 37 in the form of a frame, with the frame of the carriage 37 being approximately U-shaped with a base 38 and two side limbs 39, 39'. The pusher 36 is fitted to the carriage 37. A slide 40 is mounted on the carriage 37 such that it can move, with the slide 40 being guided, as required, on the base 38 of the U-shaped carriage 37. The switching contact 5 is arranged on the slide 40 by means of a system spring 42, which is used to make elastic contact with the fixed contact 4, 4' in the second position.

The elastic element 34 is in the form of a leaf spring, for example, a plastic leaf spring, and is held centrally on the slide 40 in an eye-like holder 43. Furthermore, at least one end of the elastic element 34 is attached to the carriage 37. Preferably, both ends of the elastic element 34 are attached to carriage 37, as shown in FIG. 7. The two ends of the elastic element 34 are preferably injection molded onto respective side limbs 39, 39' of the U-shaped carriage 37. An elongated hole 44 is located on the side limbs 39, 39' of the U-shaped carriage 37 in order to couple the slide 40 to the carriage 37, with a pin 41 on the slide 40 engaging in the elongated hole 44 for coupling purposes. Preferably, a pin 41 engages in elongated hole 40 on each of the two mutually opposite side limbs 39, 39' of U-shaped carriage 37. As can also be seen from FIG. 5, the end of the pin 41 is provided with a spherical catch 45 which, for example, interacts with a slotted-link guide in the housing 2 during movement of the carriage 37, in order to produce the snap-action effect.

Furthermore, a spark shield 46 is located on the slide 40, as can be seen in FIG. 7. The spark shield 6 can be moved between the two fixed contacts 4, 4' during switching between the two positions. In consequence, any arc which may occur during switching is interrupted, thus preventing the contact system 3 from being destroyed by such arcs.

The invention is not restricted to the described and illustrated exemplary embodiments. In fact, it also covers all specialist developments within the scope of the invention as defined by the patent claims. For example, the invention can be used not only for electrical tool switches but can also be used for other switches, for example those for controllers, domestic electrical appliances, electrical garden appliances, cookers, machine tools or the like. Furthermore, the switch may also be provided without an operating member in the form of a relay. Finally, the seal according to the invention for the electrical supply line to the electrical connections can also advantageously be used for other electrical appliances supplied from a voltage source, such as controllers, distribution boxes, or the like.

LIST OF REFERENCE SYMBOLS

1: (Electrical) switch
2: Housing
3: Contact system
4, 4': Fixed contact
5: Switching contact
6: Operating member
7: (Electrical) connection/push-in connection
8: (Electrical) supply line
9: Seal (on the connection)
10: Aperture
11: (Separate) connecting area
12: (First) cover
13: Film hinge
14: Pivoting hinge
15: Locking hook
16: Latching stud
17: Tongue and groove geometry (on the first cover)
18: Electronic/electrical circuit arrangement/electronics
19: Printed circuit board
20: (Second) cover
21: Bellows
22: Opening (in the bellows)
23: Groove (in the operating member)
24: Edge (on the housing)
25: Groove (at the edge)
26: Web
27: Capacitor
28: Holding compartment
29: (Stationary) contact spring (of the connection)
29': (Stationary) contact web (of the connection)
30: (Moving) contact spring (of the connection)
31: Control cam
32: Wheel (which can rotate)
33: Eccentric
34: Elastic element
35: Contact lug
36: Pusher (of the operating member)
37: Carriage
38: Base (of the carriage) 39, 39': Side limbs (of the carriage)
40: Slide
41: Pin (on the slide)
42: System spring
43: Eye-like holder
44: Elongated hole
45: Spherical catch
46: Spark shield
47: Compression spring
48: Half-shell

We claim:

1. An electrical switch for an electrical appliance, the electrical switch comprising:

a housing;

a contact system located in the housing and having at least one electrical connection electrically connecting the contact system to an electrical supply line; and an operating member for switching action on the contact system, wherein the at least one electrical connection has a seal surrounding and encapsulating the electrical supply line at the at least one electrical connection, wherein the seal rests on the electrical supply line connected to the at least one electrical connection and seals the electrical supply line in the at least one electrical connection, wherein the at least one electrical connection is located at least at one of an exterior surface of the housing and leads into the housing and in the housing, wherein the seal is in the form of a sleeve with an essentially round cross section and is composed of a flexible elastic material selected from the group consisting of a thermoplastic elastomer and a foam, wherein the seal is separate from the electrical supply line, and wherein the at least one electrical connection is a push-in connection for insertion of the electrical supply line, and the at least one electrical connection further comprises at least one of a stationary contact spring and a stationary contact web as well as an elastic moving contact spring, such that the electrical supply line is plugged in and held by means of contact pressure between at least one of the stationary contact spring and the moving contact spring and the stationary contact web and the moving contact spring.

2. An electrical switch for an electrical appliance, the electrical switch comprising:

a housing;

a contact system located in the housing and having at least one electrical connection electrically connecting the contact system to an electrical supply line; and an operating member for switching action on the contact system, wherein the housing comprises a separate connecting area for the at least one electrical connection, wherein the at least one electrical connection has a seal surrounding and encapsulating the electrical supply line, the seal being separate from the electrical supply line and sealing the electrical supply line in the at least one electrical connection located in the connecting area of the housing, wherein the connecting area further comprises a first movable cover that is attached to the housing by at least one of a film hinge, a pivoting hinge, latching hooks, snap-action hooks, locking hooks and latching studs, and the first cover forms a seal by one of a tongue and groove geometry and an elastomer insert, and wherein the connecting area is in the form of a chamber, and an interior of the chamber is accessible from outside after the housing is mounted via the first moveable cover.

3. The electrical switch as claimed in claim 2, wherein the at least one electrical connection further comprises an aperture into the interior of the housing, with the seal cladding the aperture, wherein the seal is positioned by at least one of inserting the seal in the aperture, placing the seal on a corresponding attachment on a surface of the housing near the aperture, and injection molding the seal in the aperture.

4. The electrical switch as claimed in claim 2, further comprising an electronic/electrical circuit arrangement for at least one of open-loop and closed-loop control of an electric motor in the electrical appliance, wherein the electronic/electrical circuit arrangement is located in a connecting area for the at least one electrical connection.

5. The electrical switch as claimed in claim 4, wherein the electronic/electrical circuit arrangement is arranged on a printed circuit board.

6. The electrical switch as claimed in claim 4, wherein the electronic/electrical circuit arrangement is inserted into a first cover of the electrical switch.

7. The electrical switch as claimed in claim 6, wherein the electronic/electrical circuit arrangement is fixed in the first cover.

8. The electrical switch as claimed in claim 7, wherein the electronic/electrical circuit arrangement is secured by latches in the first cover.

9. The electrical switch as claimed in claim 2, wherein the housing has an approximately cuboid shape that is open on a side facing the operating member;

the housing further comprises an integral second cover composed at least partially of elastic material that is arranged on the side of the housing that is open, wherein a portion of the second cover in an area surrounding the operating member comprises a thin-walled elastic and approximately bell-shaped bellows, with the bell-shaped bellows having an opening through which at least a portion of the operating member protrudes; and wherein the bell-shaped bellows is positioned in a groove in the operating member, in one of an interlocking and force-fitting manner to seal the operating member.

10. The electrical switch as claimed in claim 9, wherein the open side of the housing has a circumferential groove for engaging a circumferential web located on the second cover in one of an interlocking and force fitting manner to seal the second cover.

11. The electrical switch as claimed in claim 2, further comprising a capacitor in a holding compartment in the housing.

12. The electrical switch as claimed in claim 11, wherein the holding compartment is closed by means of a second cover.

13. The electrical switch as claimed in claim 2, wherein the connecting area is in the form of a chamber.

14. The electrical switch as claimed in claim 2, wherein the electrical appliance is one of a drill, a grinder, a saw, a plane and an angle grinder.

15. An electrical switch for an electrical appliance, the electrical switch comprising:

a housing;

a contact system located in the housing and having at least one electrical connection electrically connecting the contact system to an electrical supply line; and an operating member for switching action on the contact system, wherein the at least one electrical connection has a seal surrounding and encapsulating the electrical supply line at the at least one electrical connection, wherein the seal rests on the electrical supply line connected to the at least one electrical connection and seals the electrical supply line in the at least one electrical connection, wherein the at least one electrical connection is located at least at one of an exterior surface of the housing and leads into the housing and in the housing, wherein the seal is in the form of a sleeve with an essentially round cross section and is composed of a flexible elastic material selected from the group consisting of a thermoplastic elastomer and a foam, wherein the seal is separate from the electrical supply line, and wherein the electrical supply line is detachable from at least one electrical connection by means of a control cam;

the control cam comprising a wheel that is positioned on a first cover, and an eccentric moving against a spring force of the moving contact spring when the wheel is operated;

wherein the wheel is accessible on the first cover when the housing has been closed by means of the first cover.

16. The electrical switch as claimed in claim 15, wherein the wheel is positioned on the first cover by mounting, and rotation of the wheel detaches the electrical connection.

17. The electrical switch as claimed in claim 15, wherein the wheel is formed on the first cover by injection molding, and movement of the wheel detaches the electrical connection.

* * * * *